US007908674B2

(12) United States Patent
Jones

(10) Patent No.: US 7,908,674 B2
(45) **Date of Patent: *Mar. 22, 2011**

(54) BODY-SHAPING APPAREL

(76) Inventor: Karen E. Jones, Atlanta, GA (US)

( * ) Notice: Subject to any disclaimer, the term of this patent is extended or adjusted under 35 U.S.C. 154(b) by 849 days.

This patent is subject to a terminal disclaimer.

(21) Appl. No.: 11/337,750

(22) Filed: Jan. 23, 2006

(65) Prior Publication Data

US 2006/0189253 A1 Aug. 24, 2006

Related U.S. Application Data

(63) Continuation-in-part of application No. 10/888,646, filed on Jul. 9, 2004, now abandoned.

(51) Int. Cl.
*A41B 11/12* (2006.01)
*A41C 1/12* (2006.01)

(52) U.S. Cl. ..... 2/242; 2/311; 450/100; 450/106; 450/112

(58) Field of Classification Search ..... 2/409, 69, 2/227, 228, 238, 400–408, 231, 232, 255, 2/242, 320, 311, 312; 450/96–112; 602/60, 602/62; 66/178 R
See application file for complete search history.

(56) References Cited

U.S. PATENT DOCUMENTS

| | | | | | |
|---|---|---|---|---|---|
| 197,868 | A | * | 12/1877 | Langford | 66/178 R |
| 390,570 | A | | 10/1888 | Craig | |
| 747,139 | A | | 12/1903 | Clark | |
| 933,101 | A | | 9/1909 | Nickum | |
| 1,285,481 | A | | 11/1918 | Vincent | |
| 1,535,650 | A | | 4/1925 | Burtchby | |
| 1,589,677 | A | * | 6/1926 | Bisch | 2/320 |
| 1,751,506 | A | | 3/1930 | Bowne | |
| 2,125,451 | A | * | 8/1938 | Kolliner | 36/2 R |
| 2,889,830 | A | | 6/1959 | Raymond | |
| 2,891,549 | A | * | 6/1959 | Blatt | 450/100 |
| 3,035,586 | A | | 5/1962 | Bell | |
| 3,501,774 | A | | 3/1970 | Norman | |
| 4,003,094 | A | | 1/1977 | Newmar | |
| 4,325,379 | A | | 4/1982 | Ozbey | |
| 4,351,068 | A | * | 9/1982 | Taylor | 2/409 |
| 4,862,523 | A | | 9/1989 | Lipov | |
| 5,010,597 | A | * | 4/1991 | Glover | 2/242 |
| 5,097,537 | A | * | 3/1992 | Ewing | 2/409 |
| 5,345,613 | A | * | 9/1994 | Jones | 2/240 |
| 5,611,722 | A | | 3/1997 | Osborne | |
| 5,729,836 | A | * | 3/1998 | Ewing | 2/409 |
| 5,897,423 | A | | 4/1999 | Rosenberg | |
| 5,974,592 | A | | 11/1999 | Tabrizi | |

(Continued)

OTHER PUBLICATIONS

Orobu(R) The Original "Shock UP" Body Sculpture packaging for tights by Industria Calze SpA—Ceresara, Italy.

*Primary Examiner* — Gloria Hale
(74) *Attorney, Agent, or Firm* — Smith Frohwein Tempel Greenlee Blaha, LLC; Gregory Scott Smith

(57) ABSTRACT

The present invention provides body-shaping apparel designed to lift and support the lower portion of a person's buttocks relative to the top of the person's thighs that include a pair of loop straps that are dimensioned to encircle and engage the top of a person's thigh at the juncture of the thigh and buttock and to lift and support a buttock upwardly relative to the top of the person's thigh.

5 Claims, 4 Drawing Sheets

U.S. PATENT DOCUMENTS

| | | | | |
|---|---|---|---|---|
| 6,058,514 | A | 5/2000 | Hart | |
| 6,062,946 | A | 5/2000 | Rosenberg | |
| 6,360,375 | B1 | 3/2002 | Hart | |
| 6,430,753 | B2 | 8/2002 | Duran | |
| 6,446,268 | B1 * | 9/2002 | Lazarian | 2/255 |
| 6,533,745 | B1 * | 3/2003 | Watkins | 602/60 |
| 6,572,574 | B2 * | 6/2003 | Gardon-Mollard | 602/62 |
| 6,673,421 | B1 * | 1/2004 | Andrews et al. | 428/193 |
| 6,704,942 | B2 | 3/2004 | Lazarian | |
| 6,728,973 | B1 | 5/2004 | Webley | |
| 2002/0007507 | A1 | 1/2002 | Duran | |
| 2003/0019014 | A1 | 1/2003 | Duran | |

* cited by examiner

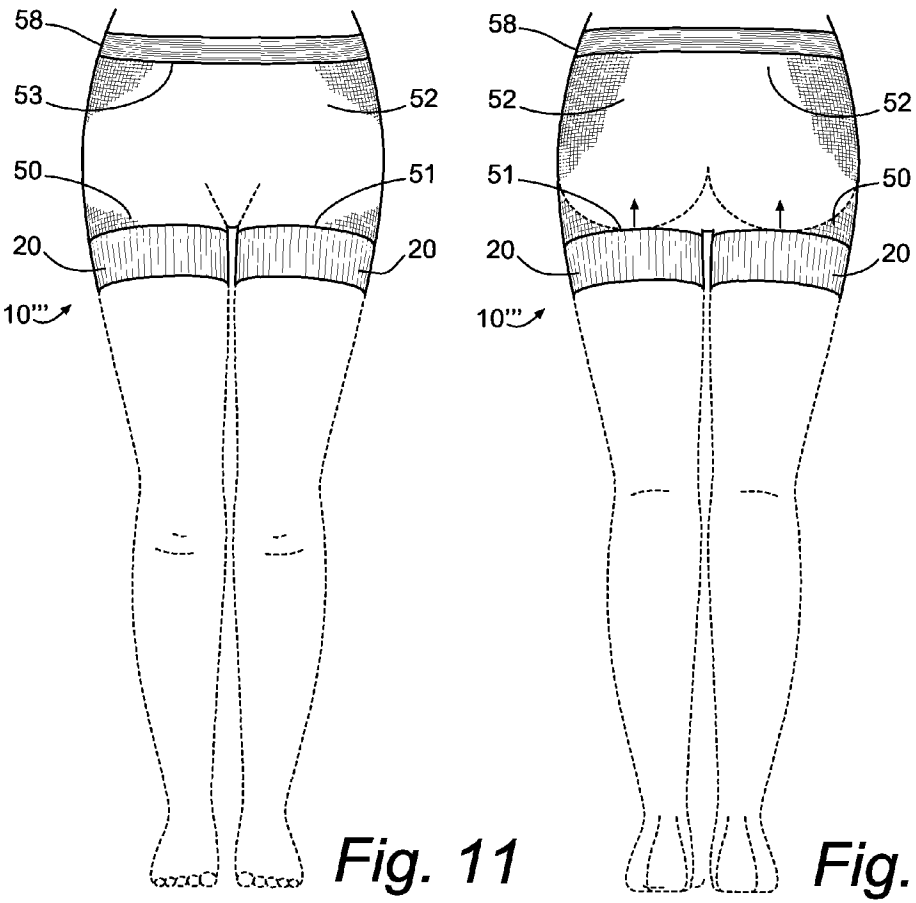
Fig. 11
Fig. 12
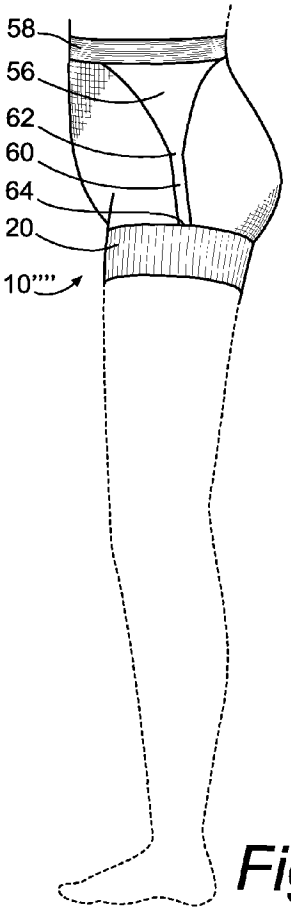
Fig. 13

BODY-SHAPING APPAREL

CROSS REFERENCE TO RELATED APPLICATIONS

This application is a continuation-in-part of U.S. patent application Ser. No. 10/888,646 entitled "Body Shaping Apparel" filed by the named inventor on Jul. 9, 2004, which application is now abandoned.

FIELD OF THE INVENTION

The present invention relates to the field of body-shaping apparel. More particularly, the present invention relates to apparel for shaping and supporting the buttocks.

BACKGROUND OF THE INVENTION

Various undergarment constructions and designs have been proposed in an attempt to improve women's and men's contours and/or profiles. Examples of undergarment constructions and designs are proposed in U.S. Pat. Nos. 390,570; 747,139; 933,101; 1,285,481; 1,535,650; 1,751,506; 2,891,549; 3,035,586; 4,003,094; 4,862,523; 5,611,722; 5,897,423; 5,974,592; 6,058,514; 6,430,753; 6,704,942 and 6,728,973. However, most of these constructions are too restrictive, too bulky, too cumbersome or do not provide adequate support and/shaping features. Moreover, many of these undergarments do not specifically lift and shape the buttocks and are not compatible with today's form fitting and revealing fashions such as hip hugging jeans, mid rift shirts and so forth.

While all of the aforementioned prior art constructions may provide some basic purpose or function for which they were specifically designed, they are uniformly deficient with respect to their failure to provide a simple, efficient and practical approach to providing concentrated support at the juncture of the user's upper thighs and their buttocks to lift and support the buttocks providing a higher and more desirable buttocks profile. For many persons, this particular portion of their anatomy can be a "problem area" that may be caused by lack of exercise, genetics, and/or age wherein, the latter cannot be avoided even by the most physically fit.

As a consequence of the foregoing situation, there has existed a longstanding need for new and improved body-shaping apparel for lifting and shaping the buttocks that have low profiles while being worn under other garments yet will provide enhanced lift and support.

SUMMARY OF THE INVENTION

The present invention provides body-shaping apparel for lifting and supporting the lower portion of a person's buttocks relative to the top of the person's thighs. In one embodiment of the present invention, the body-shaping apparel includes a pair of loop straps that are each dimensioned to encircle and engage the top of a person's thigh at the juncture of the thigh and buttock such that each strap lifts and supports a buttock upwardly relative to the top of the person's thigh. In certain embodiments, the width of each loop strap ranges from about 3 centimeters to about 13 centimeters, from about 3 centimeters to about 10 centimeters, from about 3 centimeters to about 7 centimeters and from about 4 centimeters to about 6 centimeters. The loop straps may include an interior surface that includes a tacky surface. For example, each loop strap may include an interior surface that includes at least one stripe of a tacky material or a tackified material. In certain embodiments, the stripes have width ranging from about 0.5 centimeters to about 1.5 centimeters. In certain suggested embodiments, the tacky surface is formed from a material that includes silicone.

In one particular embodiment, the body-shaping apparel consists of or consists essentially of a pair of loop straps that are each dimensioned to encircle and engage the top of a person's thigh at the juncture of the thigh and buttock such that each strap lifts and supports a buttock upwardly relative to the top of the person's thigh. In other embodiments, the body-shaping apparel further includes a pair of hosiery extensions so that one hosiery extension extends down from one of each of the pair of straps. For example, the hosiery extensions may extend down to and terminate in a region between the upper thigh and the knee. In other embodiments, the hosiery extensions extend down to and terminate in a region between the knee and the ankle. And in other embodiments, the hosiery extensions extend down to and terminate at a toe. Each of these embodiments may further include a tacky surface on the interior surface of the loop as discussed above. Moreover, embodiments of the invention may consist of or consists essentially of any combination of the elements discussed above and described herein.

In yet another embodiment, the present invention provides body-shaping apparel for lifting and supporting the lower portion of a person's buttocks relative to the top of the person's thighs, wherein the apparel includes: a brief, a pair of closed loop straps attached to the brief wherein each closed loop strap is dimensioned to encircle and engage the top of a person's thigh at the juncture of the thigh and buttock such that each strap lifts and supports a buttock upwardly relative to the top of the person's thigh. Again, each closed loop strap may include an interior surface that includes a tacky surface. In certain embodiments, the tacky surface includes at least one stripe of a tacky material or a tackified material such as silicone. In certain embodiments, the width of each closed loop strap ranges from about 3 centimeters to about 13 centimeters or any of the other ranges described herein. The body-shaping apparel may include a waistband and further include a pair of optional straps wherein each strap has an upper end that is attached to the waistband and a lower end that is attached to the closed loop strap. These straps may be adjustable straps having an upper end that is attached to the waistband and a lower end that is attached to the closed loop strap so that the height of the closed loop straps can be adjusted. The body-shaping apparel may further include connecting fabric attached to the waistband so that the straps can be attached to the connecting fabric and a lower end of the strap can be attached to a closed loop strap. Alternatively, the straps may be attached to directly to the waistband and the closed loop strap.

In yet another particular embodiment, the present invention provides body-shaping apparel for lifting and supporting the lower portion of a person's buttocks relative to the top of the person's thighs, wherein the apparel consists essentially of a brief, a pair of closed loop straps attached to the brief wherein each closed loop strap is dimensioned to encircle and engage the top of a person's thigh at the juncture of the thigh and buttock, and a waistband.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which:

FIG. 11 is a front view of a fourth embodiment; and

FIG. 12 is a rear view of the fourth embodiment of FIG. 11.

FIG. 13 is a side view of an alternate fourth embodiment.

DESCRIPTION OF THE PREFERRED EMBODIMENTS

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers have been used throughout to describe the same article. To avoid redundancy, detailed descriptions of much of the article once described in relation to a figure is not repeated in the descriptions of subsequent figures, although such article is labeled with the same reference numbers.

Figure 1:
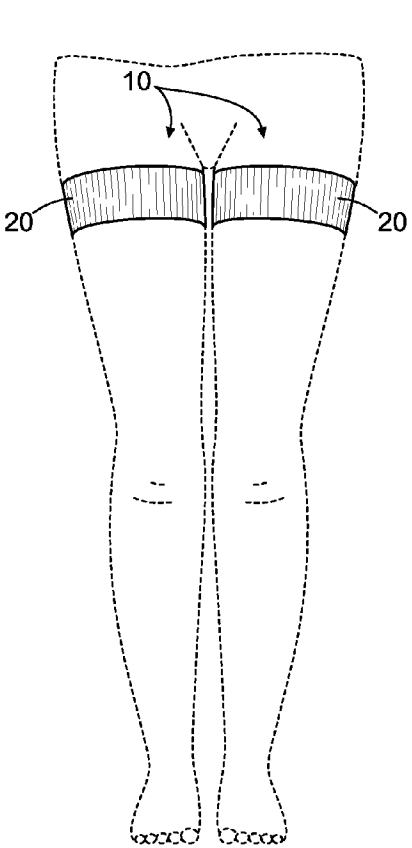
FIG. 1 is a front view of one embodiment of the apparel in use.
Figure 2:
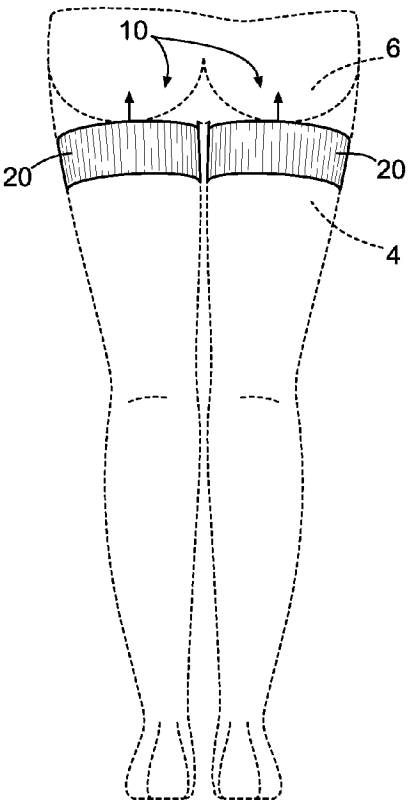
FIG. 2 is a rear view of the apparel of FIG. 1 in use.

A first preferred embodiment of the body-shaping apparel of the present invention is illustrated in FIGS. 1 and 2, a pair of leg bands generally designated 10. Each leg band 20 is designed to encircle an upper thigh 4 in a horizontal orientation and straight across the diameter or the thigh. More specifically, each band 20 is adapted and designed to be located and fit just below a buttock to provide vertical lift to the buttock 6 and shape the buttock. Desirably, the pair of leg bands provides support and lift to each buttock pushing the buttocks up to create a higher and younger looking buttocks profile. Generally, as individuals age their buttocks sag. Higher buttocks are considered to be more desirable. Advantageously, various embodiments of the present invention can lift and shape buttocks to create a more desirable profile without using padding. The body-shaping apparel of the present invention can provide lift and support to persons with aging or sagging buttocks or to other persons who would like to change the profile of their buttocks.

In certain desirable embodiments, the leg band portion 20 of the body-shaping apparel of the present invention should be fit horizontally at the transition or juncture of the upper thigh and the buttock to lift, shape and support the buttocks. For most women, this position is generally from about 1 to about 2 inches below the crotch but will vary from person to person. If the band is worn too high, the band will fold down and over itself. If the band is worn too low, the band will provide less lift and shaping. The apparel of the present invention can be worn under most articles of clothing to shape without being detected. In certain more desirable embodiments, such as the pair of leg bands illustrated in FIGS. 1 and 2 and some of the other preferred embodiments described below, the body-shaping apparel of the present invention can be worn with low cut jeans, mid rise shirts and tight-fitting clothing to provide lifting and shaping without being observed by others.

Figure 3:
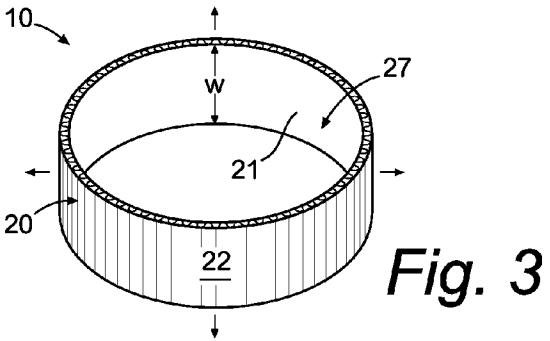
FIG. 3 is a perspective view of a closed loop embodiment of the apparel of FIG. 1.
Figure 10:
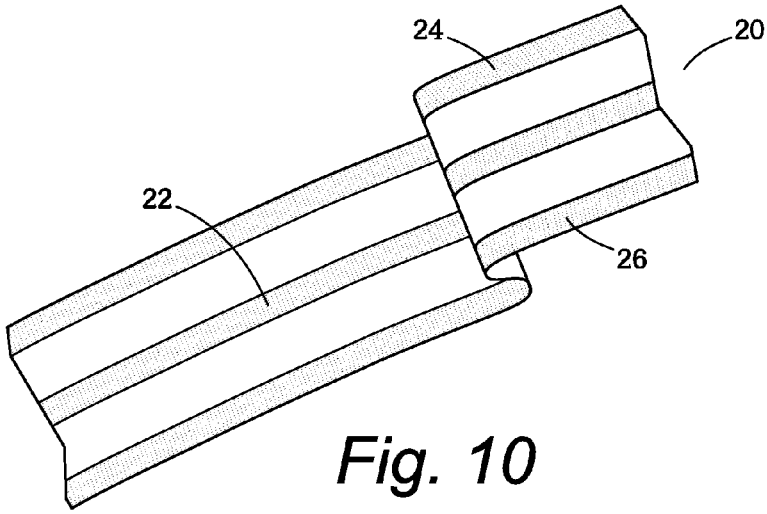
FIG. 10 is an enlarged perspective view of the interior surface of one desirable version of a closed loop strap.

In certain preferred embodiments, each leg band 20 is a closed loop strap of elastic or elasticized material as illustrated in FIG. 3. More specifically, FIG. 3 illustrates a leg band 20 that is a loop formed from an elastic or elasticized material 22 and has a width designated by "w" and a circumference defined by the length of material that is used to form the closed loop. The length of the material and the elasticity of the material can be selected by one of skill in the art to fit differing thigh circumferences and to provide varying degrees of compression for improved fit and varying degrees of comfort. Suggested elastic and elasticized materials include, but are not limited to, various nylons and nylon fabrics, SPANDEX materials and other synthetic materials or blends of such materials, particularly blends and other combinations of such materials that include additives to improve the elastic properties of the materials. Suggested additives for improving elasticity are known and include various elastomers. An enlarged view of one exemplary interior surface 22 of a leg band 20 is shown in FIG. 10. In certain desirable embodiments of the present invention, the interior surface 22 of each leg band 20 is provided with one or more strips 24 and 26 of tacky material to prevent the leg bands from slipping down or riding up the leg of a wearer during use. Suggested tacky materials include, but are not limited to, silicone and materials that contain silicone.

Figure 4:
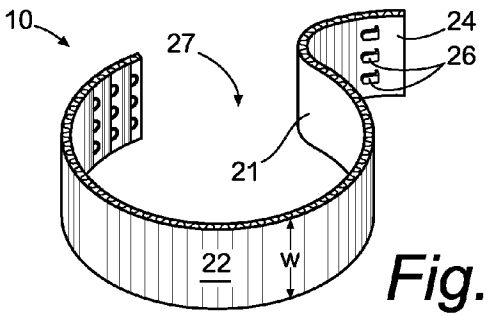
FIG. 4 is a perspective view of an adjustable strap version of the embodiment of FIG. 1.
Figure 5:
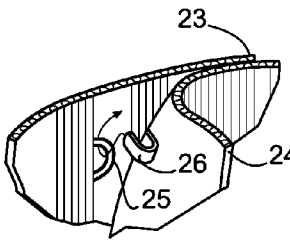
FIG. 5 is an isolated detail view of one possible variation of the fastening mechanism employed on the strap embodiment of FIG. 4.

Alternatively, each leg band 20 can be a loop strap that is adjustable in diameter as illustrated in FIGS. 4 and 5. In the embodiment illustrated in FIGS. 4 and 5, each leg band 20 is fabricated from a strip of material 22 that has opposed ends 23 and 24 provided with cooperating fastening elements 25 and 26. The cooperating fastening elements 25 and 26 may be mating hooks 26 and loops 25 as illustrated or may be one of any of the other types of fasteners used for joining two pieces of fabric, such as VELCRO-type hook and loop fasteners. In this embodiment, the cooperating fastening elements 25 and 26 allow the diameter or size of the loop opening 27 to be varied in to accommodate thighs of varying circumferences.

It can be seen that in both of the versions of the illustrated leg strap embodiments, the strips 21 of elasticized material 22 have a width "w". The width "w" can be varied to provide varying degrees of lift and/or support to the wearer's buttocks. In certain embodiments, it is suggested that the width "w" ranges from about 3 centimeters to about 13 centimeters, more preferably the width "w" ranges from about 3 centimeters to about 10 centimeters, still more preferably from about 3 centimeters to about 7 centimeters, and still more preferably from about 4 centimeters to about 6 centimeters with a suggested width being about 5 centimeters. Again, the width "w" of the strap can be varied. For example, the selection of the width of the closed loop strap will be influenced by the elasticity of the material, the degree of lift and/or support to the buttocks that is desired to be achieved and the amount of compression or comfort that is desired along with other factors. Thus, in one particularly desirable embodiment, the present invention consists of or consists essentially of a pair of integral closed loop straps that are adapted to fit and horizontally encircle an upper thigh at the transition of the upper thigh to the buttock so as to provide lift and support to the buttock where the interior surface of the leg straps may include one or more optional stripes or other regions of tacky or tackified material such as silicone. In suggested embodiments, the loop straps each include two stripes of silicone or a silicone containing material on their interior surfaces, each stripe having a width of at least about 2 centimeters, more desirably the stripes have a width of at least about 3 centimeters and formed from a silicone material that is referred to in the industry as "heavy silicone". The silicone material used to from the stripes may include additives as known in the industry to improve the processability and/or drying time of the silicone material.

Figure 6:
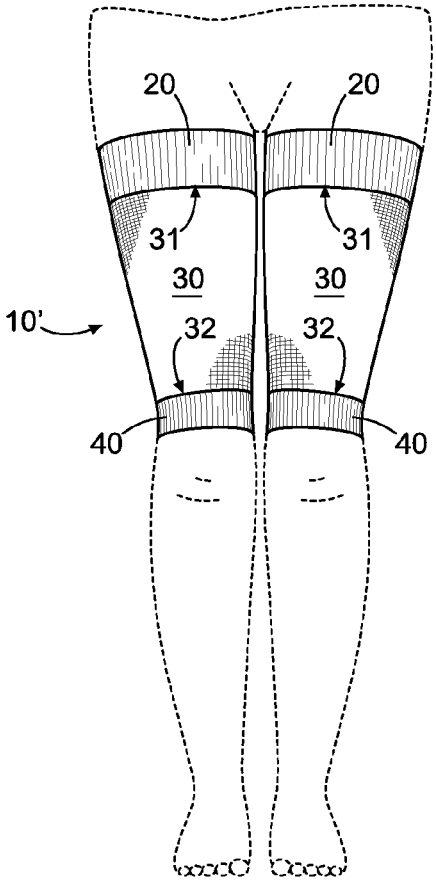
FIG. 6 is a front view of a second embodiment.
Figure 7:
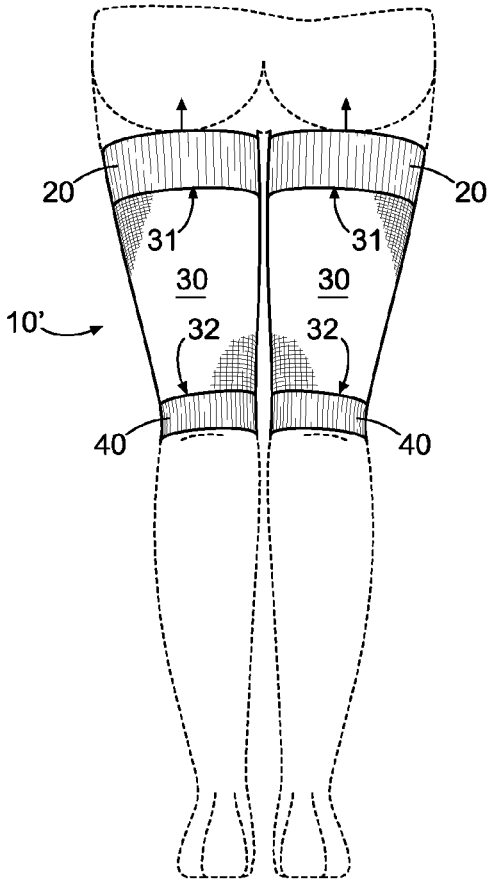
FIG. 7 is a rear view of the second embodiment of FIG. 6.

Another preferred embodiment of body-shaping apparel of the present invention is illustrated in FIGS. 6 and 7 and is designated 10'. In this second embodiment, the pair of leg bands 20 is augmented by a pair of tubular hosiery extensions 30. The hosiery extensions 30 can be formed from any material that is used for hosiery. Generally, the material of the hosiery extension should have a looser weave than the material used to form the leg band 20. In this illustrated embodiment, each tubular hosiery extension 30 has an upper end 31 affixed to one of the leg bands 20 and a lower end 32 that may be affixed to an optional resilient cuff element 40. Resilient cuff elements 40 can be provided to prevent the hosiery extensions from riding up the thighs of the wearer. The cuff element 40 is adapted to resiliently encircle a portion of the users mid to lower leg depending upon the style and/or length of the garment that is intended to be worn over the body support apparel 10'. It is suggested that the cuff element 40 is formed from the same material as the hosiery extension or a material having a weave that is intermediate to the weaves used to form the leg bands 20 and the hosiery extensions 30.

The body-shaping apparel of this knee-length embodiment can have optionally thigh shaping features depending on the elasticity of the hosiery extensions 30 and the amount of compression that the hosiery extensions 30 provide. Again, this embodiment of the present invention can shape buttocks to create a more desirable profile without using padding. The leg band portion 20 of the body-shaping apparel 10' is also fit horizontally as shown at the transition or juncture of the upper thigh and the buttock to lift, shape and support the buttocks. This body-shaping apparel can also be worn under most articles of clothing to shape without being detected, for example apparel 10' can be worn with low cut jeans and a mid rise shirt to provide lifting and shaping of the buttocks without being observed by others.

Figure 8:
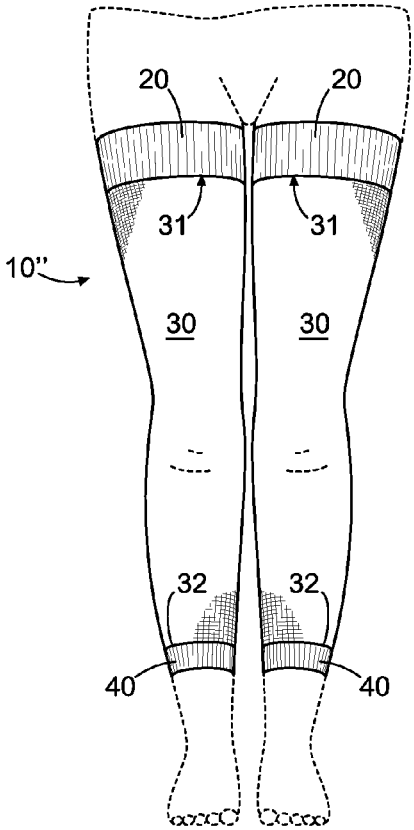
FIG. 8 is a front view of a third embodiment.
Figure 9:
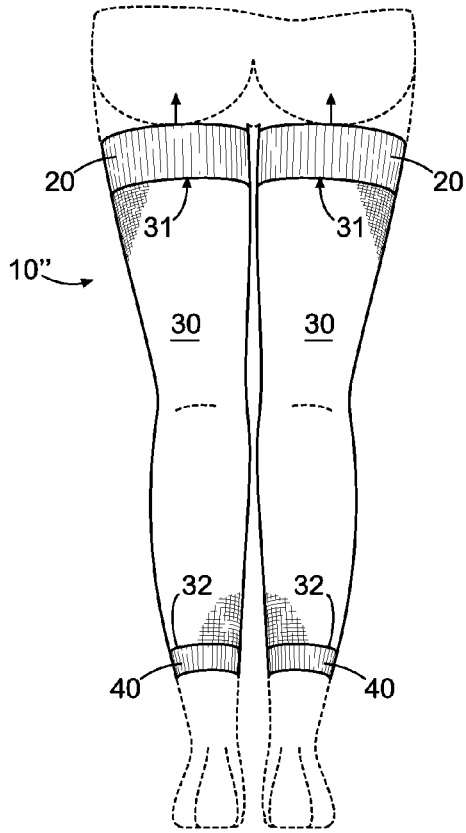
FIG. 9 is a rear view of the third embodiment of FIG. 8.

Yet another preferred embodiment of body-shaping apparel of the present invention is illustrated in FIGS. 8 and 9 and is generally designated 10". In this illustrated embodiment, the pair of leg bands 20 is augmented by a pair of tubular hosiery extensions 30 that have an upper end 31 affixed to one of the leg bands 20 and a lower end 32 that is affixed to an optional resilient cuff element 40 wherein the length of the tubular hosiery is adapted to terminate somewhere between the knee and ankle to provide Capri length body-shaping apparel. The cuff element 40 is adapted to resiliently encircle a portion of the user's lower leg between the knee and the ankle. Again, it is suggested that the cuff element 40 is formed from the same material as the hosiery extension or a material having a weave that is intermediate to the weave of the material used to form the leg bands 20 and the material that is used to form the hosiery extensions 30. The weave of the hosiery extensions may vary. For example, the upper portion of the hosiery extension can be of a tighter weave than the weave of the lower portion of the hosiery extension to provide greater thigh shaping features to the upper portion of the hosiery.

Thus, the body-shaping apparel of this Capri-length embodiment can have optionally thigh shaping features as well as buttocks shaping features. The thigh shaping features can depend on the elasticity of the hosiery extensions 30 and the amount of compression that the hosiery extensions 30 provide. This third illustrated embodiment of the present invention also shapes without using padding. The leg band portion 20 of the Capri-length embodiment 10" is fit horizontally at the transition or juncture of the upper thigh and the buttock to lift, shape and support the buttock and can be worn under articles of clothing to shape without being detected. In still other embodiments, the body-shaping apparel of the present invention has foot and toe portions as in conventional hosiery. For example, the pair of leg bands 20 can be augmented by a pair of tubular hosiery extensions 30 that have an upper end 31 affixed to one of the leg bands 20 and a lower end that terminates at a foot and a toe (not illustrated).

Yet another preferred embodiment is illustrated in FIGS. 11 and 12. In the preferred embodiment illustrated in FIGS. 11 and 12, the body-shaping apparel pair generally designated as 10''' includes a pair of leg bands 20 and also includes a pair of short tubular hosiery extensions 50 that each have a lower end 51 affixed to one of the leg bands 20 and upper ends 52 that continue upward to form a brief. The body-shaping apparel 10''' also preferably includes an optional waist band 58 and the hosiery extensions that extend up to and terminate at the waist band at their respective upper ends 53 to form a brief-type garment 10''' with buttocks shaping features. The waist band 58 is adapted to resiliently encircle the user's waist somewhere above or below the navel depending on the wearer and the style of the apparel. The waist band 58 may be formed from the same material as the hosiery extension 50 or a material having a weave that is intermediate to the weaves used to form the leg bands 20 and the hosiery extensions 50. Additionally, the weave of the hosiery extensions may vary with the lower portions 50 of the hosiery extensions being of a tighter weave than the weave of the upper portions 52 of the hosiery extensions to provide differing thigh shaping features to the upper or lower portions of the hosiery depending on where and to what extent shaping features are desired. This preferred "brief" embodiment may further include an optional gusseted crotch (not shown) to improve fit and/or comfort.

The brief embodiment 10''' may further include optional stomach flattening and/or shaping features and other optional elements such as straps 60 on each side of the brief 10''' to adjust the height of the leg bands 20 as illustrated in FIG. 13. The straps 60 can be adjustable such as the types of straps used in garter belts or brassieres. In one particular embodiment, adjustable straps 60 are attached to the waistband of the brief-type body-shaping apparel so that a strap 60 extends from each outer lateral edge of the waistband 58 down to a leg band 20 at the outer lateral side of the brief 10'''. In yet another embodiment, the straps 20 are attached to the waistband 58 of the brief-type body-shaping apparel 10''' by an optional piece of connecting fabric 56 with each strap 60 extending down from the connecting fabric 56 along the outer lateral edge of the brief to a leg band 20 as illustrated in FIG. 13. Alternatively, the upper ends of the straps 62 can be sewn directly to the waistband and extend along the outer lateral edges of the brief with the lower ends 64 of the straps attached to the leg bands 20 where the leg bands attach to the panty/brief apparel.

This attachment method may be used to improve the strength and the security of seams at the outer lateral edges of the panty or brief. In either embodiment, the straps may be adjustable so that the straps can be shortened to create more pull at the sides of the garment to further lift the buttocks as desired by the wearer of the apparel.

Wear and use of various body-shaping apparel of the present invention will be described below in relation to a pair of bands as illustrated in FIGS. 1, 2 and 3. Generally, each band 20 of a pair of bands or the upper band of one of the other embodiments is worn substantially horizontally about one inch below the crotch so that the rear facing upper edge 23 of each band touches or is just below the lower limit of a buttock and the upper limit of the thigh. This region of the anatomy is referred to as the gluteal fold and is defined as a prominent fold on the back of an upper thigh that marks the upper limit of the thigh from the lower limit of the buttock. Ideally, the gluteal fold is a prominent, almost transverse fold that marks the lower limit of a buttock. In some individuals, the gluteal fold is not very prominent. Body-shaping apparel of the present invention can improve the profile of such an individual by constricting the thigh just below the fold and/or by boosting and shaping the tissue just above the band to form a more pronounced lower buttock.

It is suggested that the edge 23 of a band 20 that has a stripe of tacky material 24 closest to an edge is worn so that that edge 23 is the top of the band. It is also suggested that any seam on the band 20 is positioned toward the inner thigh to hide the seam. If worn too high, a band 20 may fold down over itself. In such instances, it is suggested that the band is lowered horizontally down the thigh to become more effective and/or comfortable. Since sizes and shapes of individuals vary, individual users of body-shaping apparel of the invention are suggested to experiment and find the most comfortable and flattering position for the body-shaping apparel relative to their body. It should be noted that generally the upper edge 23 of the body shaping apparel should be worn higher than the upper edge of conventional thigh-high stockings.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

I claim:

1. Body-shaping apparel for lifting and supporting the lower portion of a person's buttocks relative to the top of the person's thighs, operable to be worn as an undergarment, wherein the apparel comprises:

a pair of elasticized loop straps that are each dimensioned to encircle, expand and/or contract about a person's thigh to engage the top of the person's thigh at the juncture of the thigh and buttock, wherein each strap is of an elasticity and dimension necessary to intentionally hold the buttocks of the person in an upward position when placed under the buttocks of the person and then slid upwardly into a desired holding position to thereby hold and support the person's buttocks in a position that is upward from the buttocks' natural unsupported position.

2. The body-shaping apparel of claim 1, further comprising a pair of tubular portions comprised of an elasticized material configured to provide an interference fit with a leg of the person, wherein each tubular portion is attached to and extends down from one of each of the pair of straps.

3. The body-shaping apparel of claim 2, wherein the tubular portions extend down to and terminate in a region between the upper thigh and the knee of the wearer and, wherein each loop strap has a width "w" that ranges from about 3 centimeters to about 10 centimenters.

4. An apparatus for lifting and supporting the lower portion of a person's buttocks relative to the top of the person's thighs, operable to be worn as an undergarment, wherein the apparatus comprises:

a loop strap with elasticity that is dimensioned to encircle, expand and contract about a person's thigh to engage the top of the person's thigh at the juncture of the thigh and buttock, wherein the loop strap is of an elasticity and dimension necessary to intentionally hold the buttocks of the person in an upward position when placed under the buttocks of the person and then slid upwardly into a desired holding position to thereby hold and support the person's buttocks in a position that is upward from the buttocks' natural unsupported position.

5. An apparatus for lifting and supporting the lower portion of a person's buttocks relative to the top of the person's thighs, operable to be worn as an undergarment, wherein the apparatus comprises:

a loop strap with elasticity that is dimensioned to encircle, expand and contract about a person's thigh to engage the top of the person's thigh at the juncture of the thigh and buttock, wherein the loop strap is of an elasticity and dimension necessary to intentionally hold the buttocks of the person in an upward position when placed under the buttocks of the person and then slid upwardly into a desired holding position to thereby hold and support the person's buttocks in a position that is upward from the buttocks' natural unsupported position; and a tubular portions comprised of an elasticized material operable to provide an interference fit with a leg of the person, wherein the tubular portion is attached to and extends down from the loopstrap.

* * * * *